United States Patent [19]

Dreuilhe et al.

[11] Patent Number: 4,542,716

[45] Date of Patent: Sep. 24, 1985

[54] FLUIDIZED BED COMPACT BOILER

[75] Inventors: Jacques Dreuilhe, L'Isle Adam; Roger Puff, Lens; Jean-Claude Kita, Vermelles; Jean-Francois Large, Compiegne, all of France

[73] Assignees: Creusot-Loire; Charbonnages de France, both of Paris; Institut Francais du Petrole, Rueil Malmaison, all of France

[21] Appl. No.: 622,821

[22] Filed: Jun. 21, 1984

[30] Foreign Application Priority Data

Jun. 21, 1983 [FR] France ..... 83 10233

[51] Int. Cl.[4] ..... F22B 1/00

[52] U.S. Cl. ..... 122/4 D; 110/211; 110/234; 110/245; 122/7 R; 122/235 F

[58] Field of Search ..... 110/211, 234, 245, 263, 110/346, 347; 122/4 D, 7 R, 235 F; 431/7, 170; 432/58

[56] References Cited

U.S. PATENT DOCUMENTS

| | | | |
|---|---|---|---|
| 3,101,697 | 8/1963 | Hunter | 122/4 D |
| 3,893,426 | 7/1975 | Bryers | 122/4 D |
| 4,165,717 | 8/1979 | Reh et al. | 122/4 D |
| 4,184,455 | 1/1980 | Talmud et al. | 122/4 D |
| 4,270,468 | 6/1981 | Robinson et al. | 122/4 D |
| 4,273,073 | 6/1981 | Robinson | 122/4 D |
| 4,442,795 | 4/1984 | Strohmeyer, Jr. | 122/4 D |

*Primary Examiner*—Edward G. Favors
*Assistant Examiner*—Steven E. Warner
*Attorney, Agent, or Firm*—Pollock, Vande Sande & Priddy

[57] ABSTRACT

A boiler comprising a fluidized bed combustion chamber which communicates with an exchange enclosure containing water tubes heated by the combustion tubes and within which is arranged an exchange and dust removal chamber equipped with water tubes and containing a vertical internal partition dividing it into two half chambers communicating with one another. One of these half chambers communicates with the upstream part of the enclosure through an inlet orifice situated at the top part and constrains the fumes to follow a descending path along the partition, while the other communicates with the downstream part of the enclosure through an outlet orifice situated at the top part and constrains the fumes to follow an ascending path.

2 Claims, 2 Drawing Figures

FLUIDIZED BED COMPACT BOILER

FIELD OF THE INVENTION

The present invention relates to a compact boiler with fuel combustion by fluidized bed.

BACKGROUND OF THE INVENTION

Fluidized bed boilers comprise a combustion chamber where the fuel is introduced and suspended by an ascending current of cumbustion-supporting air entraining a more or less considerable portion of ash which it is advantageous to recycle to facilitate the regulation of the temperature of the bed and/or to ensure complete combustion. The recovery of the ash is generally effected before the change bundle by convection, with the purpose of protecting the latter from erosion phenomena. In this case the trapping of the ash is customarily ensured by dust-removal equipment not integral with the boiler. The design of these boilers is cumbersome and leads to the use of relatively long ducts.

SUMMARY OF THE INVENTION

It is an object of the present invention to provide a fluidized bed boiler endowed with an integral dust-removal system securing a reduction in the bulk and in the length of the ducts and particularly efficient dust-removal.

The boiler according to the invention comprises a fluidized bed fuel combustion chamber which communicates with an exchange enclosure containing water tube layers heated by combustion fumes and within which is arranged an exchange and dust-removal chamber equipped with water tubes, a vertical internal partition dividing it into two half chambers communicating with one another at their lower part. One of these half chambers communicates with the upstream part of the enclosure through an inlet orifice situated at the top part and constrains the fumes to follow a descending path, while the other communicates with the downstream part of the enclosure through an outlet orifice situated at the top part and constrains the fumes to follow an ascending path.

According to one feature, the inlet orifice is located laterally with respect to the internal partition and faces a perpendicular wall of the chamber so that the fumes enter substantially parallel with said partition and are stopped by said wall so as to change direction and to be de-dusted.

According to another feature, the exchange and dust removal chamber comprises a hopper at the lower part.

BRIEF DESCRIPTION OF THE DRAWINGS

The invention will now be described in more detail with reference to an exemplary embodiment shown in the accompanying drawings.

In the drawings.

DETAILED DESCRIPTION

Figure 1:
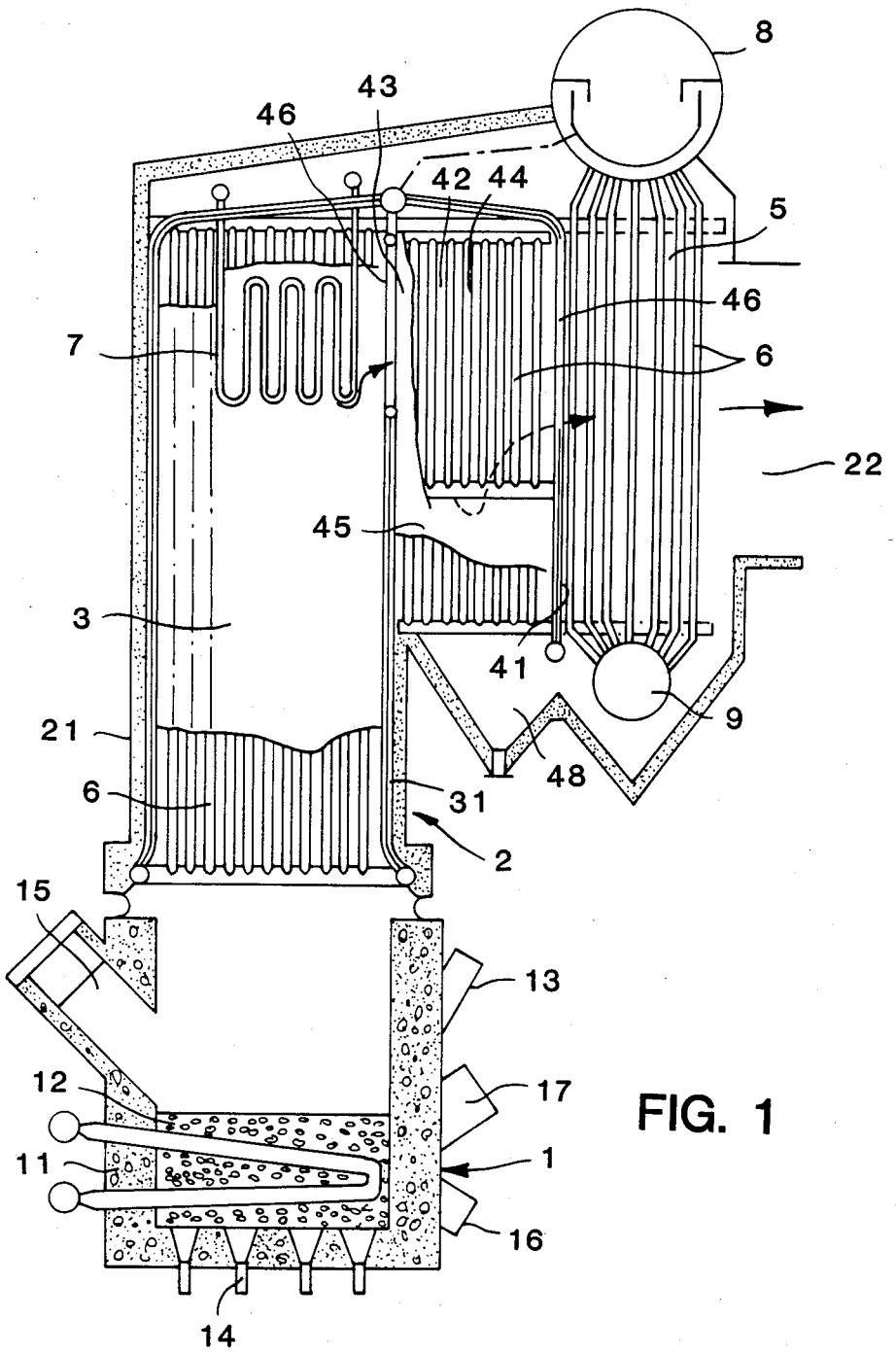
FIG. 1 is a general view, in vertical section, of the boiler.
Figure 2:
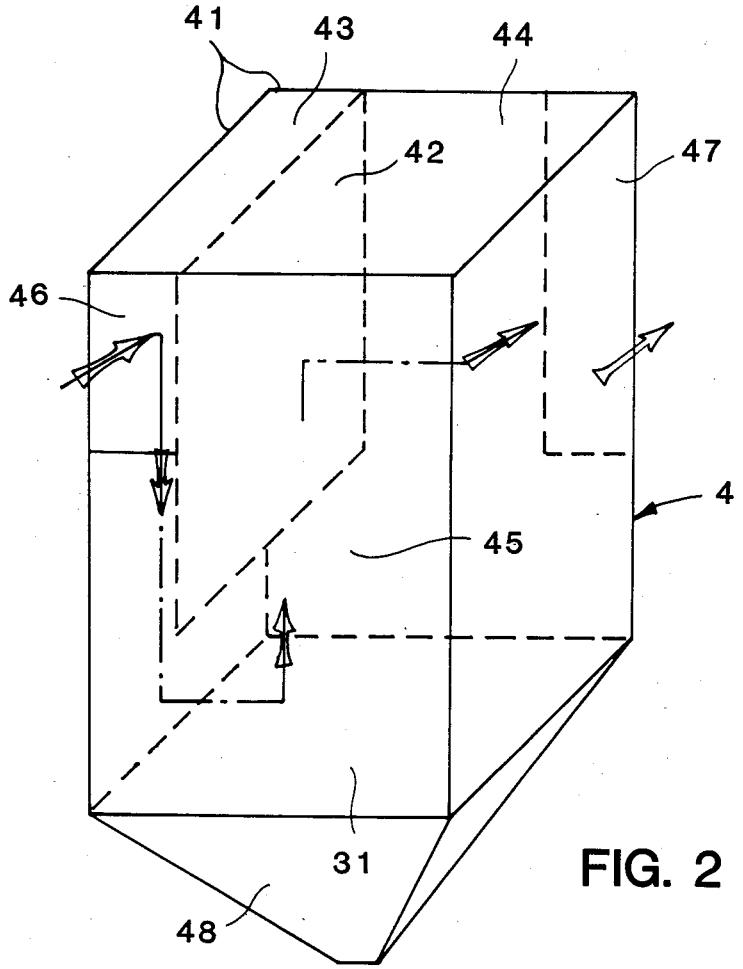
FIG. 2 shows diagrammatically, in perspective, the exchange and dust removal chamber forming part of the boiler.

The boiler comprises a combustion chamber 1 of the fluidized bed type. It is composed of a refractory enclosure 11 which contains the fluidized bed 12 of coal. The latter is introduced into the enclosure through a supply inlet 13. The bed is suspended by an ascending air current which is injected at the bottom of the enclosure through injection nozzles 14 supplied with air. Combustion is initiated by the starting burner 15. The enclosure is equipped, at the lower part, with a lateral outlet 16 which enables the ash to be removed and, higher up, with a lateral inlet 17 which enbles the introduction of recycled ash.

The combustion chamber 1 communicates with an exchange enclosure 2 containing water tubes 6 and 7 housed inside an outer jacket 21 and heated by the combustion fumes which are conducted to the outlet 22.

The fumes flow successively into an exchange chamber 3, then into an exchange and dust-removal chamber 4 and then into a terminal exchange chamber 5 which opens to the outlet 22.

The exchange chamber 3 which overhangs the fluidized bed forms a chimney lined by the vertical tubes 6. These tubes are integral in the walls 31 which are constituted by metal sheets closing the gaps between the tubes. Heat insulation is interposed between the walls 31 and the jacket 21. Tubes 6 are connected at their lower end to a lower supply loop and at their upper end to a steam release header. The tubes of the wall 31 are interrupted on the side of the chamber 4 so as to form an inlet orifice 46.

The exchange and dust removal chamber 4 is bounded by a common wall 31 forming an inlet orifice and by the walls 41. Tubes 6 are integral in the walls 41 constituted by metal sheets closing the gaps between the tubes.

This chamber contains a vertical inner partition 42 which can be produced by means of water circulation tubes. It divides the chamber into two half chambers 43 and 44, these hålf chambers communicating at the bottom of the partition through a communication orifice 45. The upstream half chamber 43 communicates with the chamber 3 through the inlet orifice 46 situated at the top part. The downstream half chamber 44 communicates with the terminal chamber 5 through an outlet orifice 47 situated at the top part.

Vertical tubes 6 are integrated into the walls 41 and into the partition 42 which are constituted by metal sheets closing the gaps between the tubes. The tubes of the inner partition open at their ends into a supply manifold and into a release manifold. The tubes of the walls open at their ends into a supply manifold and into a release tube. The exchange and dust removal chamber comprises at the lower part a hopper 48 permitting the ash to be recovered to recycle it to the inlet 17 and/or to evacuate it.

The inlet orifice 46 is situated laterally with respect to the inner partition 42 and faces a perpendicular wall 41 so that the fumes enter substantially parallel with the partition and are stopped by said opposite wall 41. The fumes descend into the half chamber 43 along the partition 42 and pass through the orifice 45 and then reascend into the half chamber 44 to the outlet orifice 47.

Due to the sudden changes in direction of the fumes in the chamber 4, the latter are separated from the ash that they contain. The position of the partition 42, as well as its height, have been defined so that the ash retained and collected in the hopper 48 is not taken up again by the fumes.

By way of example, the table below groups the trapping efficiencies of the dust-removal chamber, obtained on a model, as a function of the charge of ash in the fumes and the height of the partition 42 when the latter is positioned close to the inlet orifice 46.

| Height of the partition 42 | Charge of ash in the fumes ($g/m^3$) | Yield (%) | Height of the partition 42 | Charge of ash in the fumes ($g/m^3$) | Yield (%) |
|---|---|---|---|---|---|
| ⅓ of the height of wall 41 | 60 | 45 | Height of the wall 41 | 60 | 29 |
| | 180 | 52 | | 180 | 52 |
| | 320 | 49 | | 320 | 59 |

The terminal chamber 5 contains vertical tubes 6 which are connected to a collector tank 8 equipped with devices for drying the steam and situated at the upper part and to a tank 9 situated at the lower part.

The steam collected in the release manifolds is conducted to the manifold tank 8 which receives also the steam produced through the tubes of the chamber 5.

The bundle 7 constitutes a superheater.

We claim:

1. Compact fluidized bed boiler having at its lower part a combustion chamber (1) which communicates with an enclosure (2) forming, in succession, an exchange chamber (3) containing water tubes (6, 7), an exchange and dust removal chamber (4), and a terminal exchange chamber (5), said exchange and dust removal chamber being divided into first and second half chambers (43, 44) communicating at their lower parts by a vertical internal partition (42), said first half chamber (43) communicating with said exchange chamber (3) through an inlet orifice (46) located laterally relative to said internal partition (42) and facing a wall (41) so that fumes enter substantially parallel to said partition (42) and are stopped by said wall (41) so as to change direction and to be de-dusted, said second half chamber (44) communicating with said terminal exchange chamber (5) through an outlet orifice (47) located laterally relative to said internal partition (42) and opposite said inlet orifice (46) so as to cause a further change of direction of said fumes as well as supplementary de-dusting.

2. Boiler according to claim 1, wherein said internal partition (42) comprises water tubes (6).

* * * * *